US011128950B2

(12) United States Patent
Cao et al.

(10) Patent No.: US 11,128,950 B2
(45) Date of Patent: Sep. 21, 2021

(54) SPEAKER MODULE

(71) Applicant: GOERTEK INC., WeiFang (CN)

(72) Inventors: Xiaodong Cao, WeiFang (CN); Jinli Liu, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 16/099,158

(22) PCT Filed: Dec. 30, 2016

(86) PCT No.: PCT/CN2016/113601
§ 371 (c)(1),
(2) Date: Nov. 5, 2018

(87) PCT Pub. No.: WO2017/190515
PCT Pub. Date: Nov. 9, 2017

(65) Prior Publication Data

US 2019/0253789 A1 Aug. 15, 2019

(30) Foreign Application Priority Data

May 5, 2016 (CN) ..... 201610293493.1

(51) Int. Cl.
*H04R 1/28* (2006.01)
*H04R 9/02* (2006.01)
(Continued)

(52) U.S. Cl.
CPC ..... *H04R 1/288* (2013.01); *H04R 1/025* (2013.01); *H04R 9/02* (2013.01); *H04R 9/06* (2013.01)

(58) Field of Classification Search
CPC ..... H04R 1/403; H04R 1/288; H04R 1/22; H04R 1/025; H04R 1/1016; H04R 1/2803;
(Continued)

(56) References Cited

U.S. PATENT DOCUMENTS 3,108,162 A * 10/1963 Schindler ..... H04R 19/01 381/174
4,085,087 A * 4/1978 Kratel ..... C09K 3/16 524/414
(Continued)

FOREIGN PATENT DOCUMENTS

CN 2674805 Y 1/2005
CN 1886296 A 12/2006
(Continued)

OTHER PUBLICATIONS

First Office Action, Chinese Application 201610293493.1, State Intellectual Property Office of the P.R. of China, dated May 23, 2017.
(Continued)

*Primary Examiner* — Alexander Krzystan
*Assistant Examiner* — Julie X Dang
(74) *Attorney, Agent, or Firm* — Holzer Patel Drennan

(57) ABSTRACT

Disclosed is a speaker module, comprising a module housing and a speaker unit accommodated in the module housing. The speaker unit partitions a module cavity encircled by the module housing into two cavities, namely a front acoustic cavity and a rear acoustic cavity. A separator component is provided within the rear acoustic cavity. The separator component partitions the rear acoustic cavity into an accommodating cavity and a sound-absorbing cavity. The sound-absorbing cavity is filled with sound-absorbing particles. An antistatic material is added into the housing material of the module housing at where the sound-absorbing cavity is located, or the antistatic material is coated on the surface of the module housing at where the sound-absorbing cavity is located, and the antistatic material is either an electrically-conductive material or an antistatic agent. The speaker module of the present invention is capable of greatly increasing the fill rate of the sound-absorbing particles in the
(Continued)

sound-absorbing cavity of the rear acoustic cavity of the speaker module, thus allowing the space of the rear acoustic cavity of the speaker module to be fully utilized and the sound-absorbing particles to fully exert the effects thereof in improving the acoustic properties of the speaker module, and greatly increasing the acoustic properties of the speaker module.

6 Claims, 1 Drawing Sheet

(51) Int. Cl.
*H04R 9/06* (2006.01)
*H04R 1/02* (2006.01)

(58) Field of Classification Search
CPC .. H04R 1/2811; H04R 1/2819; H04R 1/2834; H04R 1/2857; H04R 9/02; H04R 9/06
USPC ..... 381/345, 351, 346, 353
See application file for complete search history.

(56) References Cited

U.S. PATENT DOCUMENTS 4,953,655 A * 9/1990 Furukawa ..... H04R 1/2819 181/156
2008/0135327 A1* 6/2008 Matsumura ..... G10K 11/172 181/151
2009/0028370 A1* 1/2009 Matsumura ..... H04R 1/2803 381/386
2010/0291379 A1* 11/2010 Jo ..... C09D 5/08 428/336
2013/0308812 A1* 11/2013 Shen ..... H04R 1/288 381/346
2014/0003634 A1* 1/2014 Ito ..... H04R 19/02 381/190
2016/0293436 A1* 10/2016 Yokota ..... H01L 21/31053
2017/0041704 A1* 2/2017 Herold ..... H04R 1/2811
2017/0048600 A1* 2/2017 Pu ..... H04R 1/023
2017/0289672 A1* 10/2017 Yang ..... H04R 1/2811

FOREIGN PATENT DOCUMENTS

CN 201263207 Y * 6/2009
CN 201263207 Y 6/2009
CN 103763673 A 4/2014
CN 203708465 U * 7/2014
CN 104202703 A 10/2014
CN 104202703 A * 12/2014 ..... H04R 1/22
CN 203984671 U * 12/2014
CN 204498347 U 7/2015
CN 204498363 U 7/2015
CN 204948357 U 1/2016
CN 205179352 U 4/2016
CN 205232448 U 5/2016
CN 105872917 A 8/2016
CN 105916081 A 8/2016
CN 105959882 A 9/2016
CN 205596321 U 9/2016
CN 205596331 U 9/2016
CN 205029855 U 10/2016
GB 2213492 A * 8/1989 ..... C04B 28/26
JP 2005-301188 A 10/2005
KR 20100029266 A * 3/2010 ..... B22F 9/14
WO WO-2014115745 A1 * 7/2014 ..... C08G 81/00

OTHER PUBLICATIONS

Second Office Action, Chinese Application 201610293493.1, State Intellectual Property Office of the P.R. of China, Oct. 16, 2018.
International Search Report issued for PCT/CN2016/113601 by State Intellectual Property Office of the Peoples Republic of China, dated Mar. 20, 2017.

* cited by examiner

SPEAKER MODULE

CROSS-REFERENCE TO RELATED APPLICATIONS

The present application is a US national stage entry of International Patent Application Serial No. PCT/CN2016/113601, filed Dec. 30, 2016, which claims priority to Chinese Patent Application Serial No. 201610293493.1, filed May 5, 2016. Each of these applications are hereby incorporated by reference for all that they disclose or teach.

TECHNICAL FIELD OF THE INVENTION

The present invention relates to a technical field of electro-acoustic products, and more particularly, to a speaker module.

BACKGROUND OF THE INVENTION

The speaker module is an important acoustic component of a portable electronic device for converting between an electrical signal and a sound signal, and is an energy conversion device. The existing speaker module generally comprises a module housing and a speaker unit, wherein the module housing forms a module cavity for accommodating the speaker unit therein, and the speaker unit separates the module cavity into a front acoustic cavity and a rear acoustic cavity, and a sound absorbing component made of a sound absorbing material such as sound absorbing cotton may be disposed in the rear acoustic cavity to adjust the acoustic performance of the module.

In recent years, with the increasing thinness and lightness of wearable electronic products, the sound absorbing components made of conventional sound absorbing materials have been unable to meet the debugging and calibration requirements of the acoustic performance in the micro speaker industry. In order to solve this problem, new sound absorbing materials are constantly being developed and experimented, and it has been verified that the acoustic performance can be effectively improved by placing porous sound absorbing materials in the rear acoustic cavity of the speaker module. At present, such new sound absorbing materials with good application effects include non-foaming sound absorbing materials such as natural zeolite, activated carbon, white carbon black, silicon dioxide, artificial zeolite, or a mixture of the above two or more materials. When the above-described non-foaming sound absorbing material is applied to the speaker, the above powdery non-foaming sound absorbing material is required to be firstly prepared into sound absorbing particles having a particle diameter of 0.1 to 1.0 mm for the quantifiability and process filling practicability. According to the size configuration of the rear acoustic cavity of the speaker products, the particle size of the sound absorbing particles of the non-foaming sound absorbing materials can be selected within a range of 0.1 to 1.0 mm.

At present, the following method can be adopted to manufacture the sound absorbing component by using the above-mentioned non-foaming sound absorbing materials in the speaker industry: an independent ventilating cavity is constructed in the rear acoustic cavity of the speaker module by a wire mesh cloth, a metal mesh or the like added in the housing of the speaker module in combination with the housing of the speaker module, and then a filling hole is reserved on the independent ventilating cavity in advance to complete the direct filling of the non-foaming sound absorbing material particles, thereby forming the sound absorbing component.

Since the non-foaming sound absorbing material itself is a porous material and has a high specific surface area, therefore static electricity is easily generated when the non-foaming sound absorbing material comes into contact with air, moreover, the non-foaming sound absorbing material is an insulator, which causes the electric charge to continuously accumulate and the electrostatic effect to continuously enhance. In addition, the porous non-foaming sound absorbing material itself has polar defect point and will be charged itself. Due to the above-described two reasons, the electrostatic problem in the filling of the non-foaming sound absorbing material particles occurs, which results in the following adverse effects:

1. In the filling process of the independent ventilating cavity of the speaker module, the non-foaming sound absorbing material particles cannot completely fill the predetermined filling area due to the electrostatic repulsion effect between the particles, and the filling amount is small with the fill rate of about 55% to 75%, so that it is difficult to effectively utilize the space of the rear acoustic cavity of the speaker, and the improvement effect on the acoustic performance of the speaker is significantly restrained;

2. Since the non-foaming sound absorbing material particles are prone to generate static electricity, when the particles are packaged to form a sound absorbing component after filling, a certain number of particles may enter into the package area, causing failure of the packaging operation and low package yield, or affecting the package strength, and, the package is easily damaged in the working process of the speaker module due to factors such as aging and external forces, resulting in leakage of sound absorbing particles and thereby affecting the acoustic quality of the speaker.

SUMMARY OF THE INVENTION

The technical problem to be solved by the present invention is to provide a speaker module with good acoustic performance.

In order to solve the above technical problem, the technical solutions of the present invention are as follows.

A speaker module comprising a module housing and a speaker unit accommodated in the module housing, wherein the speaker unit separates a module cavity encircled by the module housing into two cavities, namely a front acoustic cavity and a rear acoustic cavity, and an insulating member is disposed in the rear acoustic cavity, the insulating member separates the rear acoustic cavity into an accommodating cavity and a sound absorbing cavity, and the sound absorbing cavity is filled with sound absorbing particles, and wherein, an antistatic material is added into a housing material of a portion of the module housing constituting the sound absorbing cavity, or the antistatic material is coated on an inner surface of the portion of the module housing constituting the sound absorbing cavity, and the antistatic material is a conductive material or an antistatic agent.

Preferably, a filling opening is disposed on the module housing at a position of the sound absorbing cavity, and the antistatic material is added into the housing material of a portion of the module housing corresponding to the filling opening, or the antistatic material is coated on an inner surface of the module housing corresponding to the filling opening.

Preferably, surfaces of the sound absorbing particles are coated with electric inductive metal films or sprayed with the antistatic agent.

Preferably, the material of the electric inductive metal film is one of a metal block polymer of polyether, glycerol-stearate or a derivative of ethylene oxide.

Preferably, the surface of the sound absorbing particles is subjected to a polishing treatment and the powder falling rate wt % is ≤0.1.

Preferably, the antistatic material is added into the housing material of the portion of the module housing corresponding to the filling opening, and the antistatic material is added in an amount of 0.1% to 10% by weight with respect to the housing material.

Preferably, the antistatic material is added in an amount of 0.1% to 5% by weight with respect to the housing material.

Preferably, the conductive material is one or more of carbon black, metal and metal oxide.

Preferably, the antistatic agent is one or more of quaternary ammonium salts, phosphates, fatty acid esters, ammonium ethoxide, alkyl sulfonates and acrylic acid derivatives.

According to the above-described technical solutions, the advantageous effects of the present invention are as follows.

In the speaker module of the present invention, an antistatic material is added into a housing material of the portion of the module housing constituting the sound absorbing cavity, or the antistatic material is coated on an inner surface of the portion of the module housing constituting the sound absorbing cavity, and the antistatic material is a conductive material or an antistatic agent. The speaker module having such structure can improve the electrostatic properties of the module housing at the sound absorbing cavity, enhance the antistatic capability of the module housing at the sound absorbing cavity, and greatly increase the fill rate of the sound absorbing particles in the sound absorbing cavity, so that the space of the rear acoustic cavity of the speaker module can be fully utilized, and the sound absorbing particles can fully exert the effect of improving the acoustic performance of the speaker module, and it is more conductive to the reduction of the speaker module F0. Meanwhile, the effective elimination of static electricity prevents the sound absorbing particles from adhering to the package area of the filling opening of the sound absorbing cavity, thereby greatly reducing the problem of poor package strength due to the inclusion of sound absorbing particles in the package area of the filling opening of the sound absorbing cavity, and making the package area of the sound absorbing cavity not easily to be damaged and leak, and increasing the package yield which can be increased to ≥95%, improving the service life of the speaker module, and reducing the use-cost of the speaker module.

REFERENCE NUMERAL

1: module housing; 2: front acoustic cavity; 3: rear acoustic cavity; 31: sound absorbing cavity; 32: sound absorbing particles; 33: filling opening; 4: insulating member; 5: antistatic material.

DETAILED DESCRIPTION OF EMBODIMENTS OF THE INVENTION

In order to make the purposes, technical solutions and advantages of the present invention clear, the present invention will be further described in detail below in combination with the accompanying drawings and embodiments. It is to be understood that the specific embodiments described herein are merely illustrative of the invention and are not intended to limit the invention.

The First Embodiment

Figure 1:
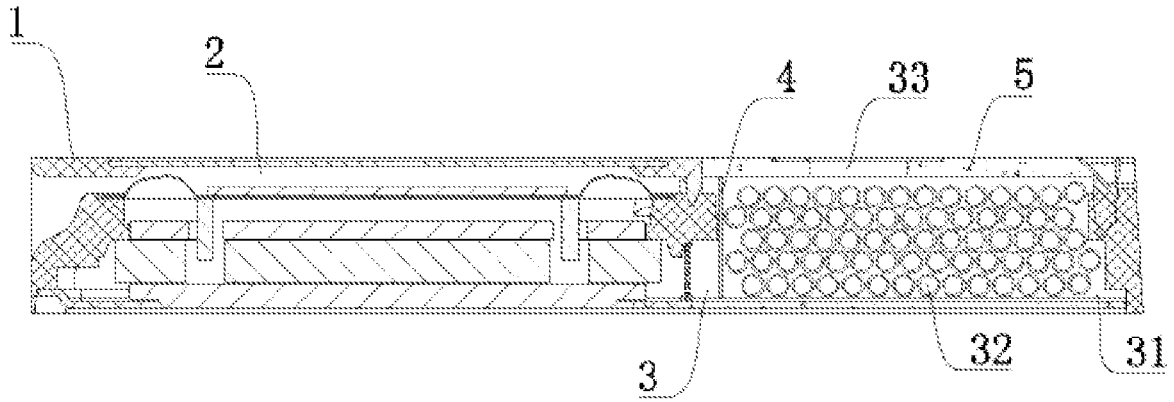
FIG. 1 is a structural schematic diagram of a speaker module according to a first embodiment of the present invention.

Referring to FIG. 1, the speaker module according to the present embodiment comprises a module housing 1 and a speaker unit accommodated in the module housing 1. The speaker unit separates a module cavity encircled by the module housing into two cavities, namely a front acoustic cavity 2 and a rear acoustic cavity 3, and an insulating member 4 is disposed in the rear acoustic cavity 3, the insulating member 4 separates the rear acoustic cavity 3 into an accommodating cavity and a sound absorbing cavity 31, the sound absorbing cavity 31 is filled with sound absorbing particles 32, and a filling opening 33 is disposed on the module housing 1 at the position of the sound absorbing cavity 31, and an antistatic material is added into the housing material of a portion of the module housing 1 constituting the sound absorbing cavity 31. Preferably, the antistatic material may be added into the housing material of a portion of the module housing that corresponds to the portion provided with the filling opening 33, and the specific embodiment is not limited to FIG. 1. In the material of the portion of the module housing into which the antistatic material 5 is added, the antistatic material 5 is added in an amount of 0.1% to 10% by weight with respect to the housing material. Preferably, in the material of the portion of the module housing into which the antistatic material 5 is added, the antistatic material 5 is added in an amount of 0.1% to 5% by weight with respect to the housing material. By adding the antistatic material into the housing material of the portion of the module housing 1 corresponding to the filling opening 33, the electrostatic properties of the module housing can be improved, and the fill rate of the sound absorbing particles in the sound absorbing cavity and the package yield of the sound absorbing cavity can be greatly increased.

Surfaces of the sound absorbing particles 32 are coated with electric inductive metal films or sprayed with an antistatic agent, so as to improve the surface conductivity of the sound absorbing particles 32 and enhance the antistatic property of the sound absorbing particles 32.

The material of the electric inductive metal film is one of a metal block polymer of polyether, glycerol-stearate or a derivative of ethylene oxide.

The surface of the sound absorbing particles is subjected to a polishing treatment and the powder falling rate wt % is ≤0.1, so that the particle wear rate, i.e., the powder falling rate (wt %) is ≤0.1, and the accumulation of electric charge due to the friction of the rough surface of the sound absorbing particles is reduced.

The conductive material is one or more of carbon black, metal and metal oxide.

The antistatic agent is one or more of quaternary ammonium salts, phosphates, fatty acid esters, ammonium ethoxide, alkyl sulfonates and acrylic acid derivatives.

The Second Embodiment

Figure 2:
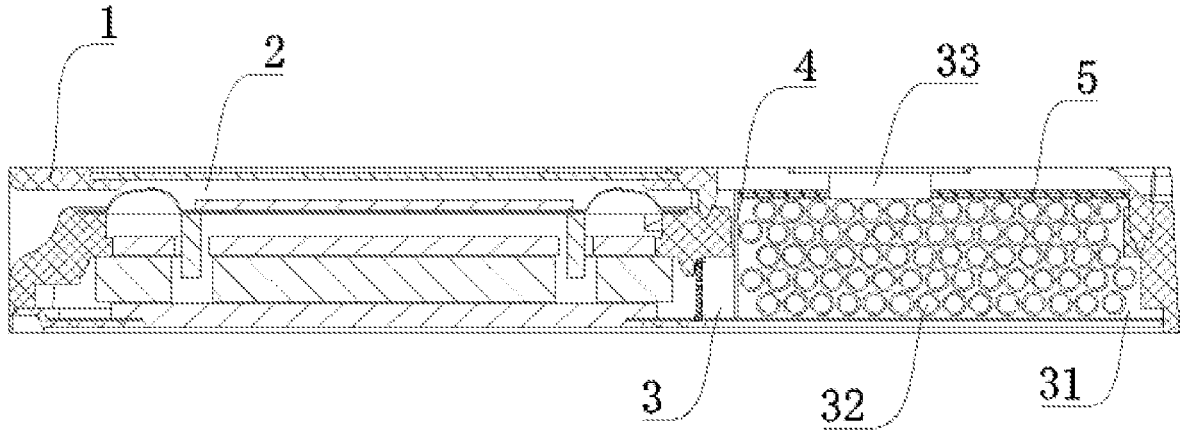
FIG. 2 is a structural schematic diagram of a speaker module according to a second embodiment of the present invention.

Referring to FIG. 2, the structure of the speaker module of the present embodiment is substantially the same as that of the first embodiment, except that the antistatic material 5 is coated on the inner surface of the portion of the module housing 1 constituting the filling opening 33. Preferably, the antistatic material 5 may be coated on the inner surface of the portion of the module housing 1 corresponding to the filling opening 33. Such structure can increase the surface conductivity of the module housing 1, so that the surface resistance of the area coated with the antistatic material 5 is $\leq 10^{12}\Omega$, thereby achieving the purpose of improving the electrostatic properties of the module housing 1.

The above is examples of preferred embodiments of the present invention, and contents that are not described in detail are common knowledge to those skilled in the art. The scope of the present invention is defined by the appended claims, and any equivalent changes based on the technical enlightenment of the present invention are also within the scope of the present invention.

The invention claimed is:

1. A speaker module comprising a module housing and a speaker unit accommodated in the module housing, wherein the speaker unit separates a module cavity encircled by the module housing into two cavities, namely a front acoustic cavity and a rear acoustic cavity, and an insulating member is disposed in the rear acoustic cavity, the insulating member separates the rear acoustic cavity into an accommodating cavity and a sound absorbing cavity, and the sound absorbing cavity is filled with sound absorbing particles comprising a non-foaming sound absorbing material, wherein an antistatic material is coated on an inner surface of a portion of the module housing constituting the sound absorbing cavity, and the antistatic material is a conductive material or an antistatic agent, wherein a filling opening is disposed on the module housing at a position of the sound absorbing cavity for receiving the sound absorbing particles therethrough into the sound absorbing cavity, and the antistatic material is coated on the inner surface of the module housing corresponding to the filling opening.

2. The speaker module according to claim 1, wherein surfaces of the sound absorbing particles are coated with electric inductive metal films or sprayed with the antistatic agent.

3. The speaker module according to claim 2, wherein the material of the electric inductive metal film is one of a metal block polymer of polyether, glycerol-stearate or a derivative of ethylene oxide.

4. The speaker module according to claim 1, wherein surfaces of the sound absorbing particles are subjected to a polishing treatment and a powder falling rate wt % is $\leq 0.1$.

5. The speaker module according to claim 1, wherein the conductive material is one or more of carbon black, metal and metal oxide.

6. The speaker module according to claim 1, wherein the antistatic agent is one or more of quaternary ammonium salts, phosphates, fatty acid esters, ammonium ethoxide, alkyl sulfonates and acrylic acid derivatives.

* * * * *